US012471619B2

(12) United States Patent
Capelli et al.

(10) Patent No.: US 12,471,619 B2
(45) Date of Patent: Nov. 18, 2025

(54) AEROSOL-GENERATING SUBSTRATE COMPRISING AN AEROSOL-GENERATING FILM

(71) Applicant: Philip Morris Products S.A., Neuchatel (CH)

(72) Inventors: Sebastien Capelli, Neuchatel (CH); Onur Dayioglu, Neuchatel (CH); Robert Emmett, Neuchatel (CH); Jean-Yves Vollmer, Neuchatel (CH)

(73) Assignee: Philip Morris Products S.A., Neuchatel (CH)

( * ) Notice: Subject to any disclaimer, the term of this patent is extended or adjusted under 35 U.S.C. 154(b) by 529 days.

(21) Appl. No.: 17/602,114

(22) PCT Filed: Mar. 18, 2020

(86) PCT No.: PCT/EP2020/057507
§ 371 (c)(1),
(2) Date: Oct. 7, 2021

(87) PCT Pub. No.: WO2020/207733
PCT Pub. Date: Oct. 15, 2020

(65) Prior Publication Data

US 2022/0175017 A1 Jun. 9, 2022

(30) Foreign Application Priority Data

Apr. 8, 2019 (EP) ..... 19167966

(51) Int. Cl.
*A24B 15/167* (2020.01)
*A24B 15/32* (2006.01)
(Continued)

(52) U.S. Cl.
CPC ..... *A24B 15/167* (2016.11); *A24B 15/32* (2013.01); *A24D 1/18* (2013.01); *A24D 1/20* (2020.01); *A24F 40/20* (2020.01); *A24F 40/46* (2020.01)

(58) Field of Classification Search
None
See application file for complete search history.

(56) References Cited

U.S. PATENT DOCUMENTS 4,981,522 A 1/1991 Nichols et al.
5,060,671 A 10/1991 Counts et al.
(Continued)

FOREIGN PATENT DOCUMENTS

AU 2012207021 A1 8/2012
CN 102669810 A * 9/2012 ..... A23L 27/79
(Continued)

OTHER PUBLICATIONS

WO-2018235959-A1, Yamada. English machine translation, generated from PE2E Search 2018.*
(Continued)

*Primary Examiner* — Katherine A Will
*Assistant Examiner* — Michael T Fulton
(74) *Attorney, Agent, or Firm* — Oblon, McClelland, Maier & Neustadt, L.L.P.

(57) ABSTRACT

An aerosol-generating article including a rod of aerosol-generating substrate is provided, the rod including: an aerosol-generating film comprising at least 25 percent by weight of a polyhydric alcohol and at least 10 percent by weight of a cellulose based film-forming agent, the aerosol-generating film being configured such that an exposed surface area of the aerosol-generating film within the aerosol-generating substrate is at least 5 square millimeters per mg of the aerosol-generating film, and the aerosol-generating film
(Continued)

being substantially tobacco-free. A rod for use as an aerosol-generating substrate in an aerosol-generating article, and an aerosol-generating system including an aerosol aerosol-generating article and an electrically operated aerosol-generating device are also provided.

22 Claims, 1 Drawing Sheet

(51) Int. Cl.

| | |
|---|---|
| ***A24D 1/18*** | (2006.01) |
| ***A24D 1/20*** | (2020.01) |
| ***A24F 40/20*** | (2020.01) |
| ***A24F 40/46*** | (2020.01) |

(56) References Cited

U.S. PATENT DOCUMENTS

| | | | | |
|---|---|---|---|---|
| 10,492,542 | B1 | 12/2019 | Worm et al. | |
| 2009/0065011 | A1 | 3/2009 | Maeder et al. | |
| 2012/0006343 | A1 | 1/2012 | Renaud et al. | |
| 2013/0037041 | A1 | 2/2013 | Worm et al. | |
| 2014/0166032 | A1 | 6/2014 | Gindrat | |
| 2015/0272225 | A1 | 10/2015 | Worm et al. | |
| 2016/0295926 | A1 | 10/2016 | Zuber | |
| 2018/0192707 | A1 | 7/2018 | Worm et al. | |
| 2018/0199616 | A1 | 7/2018 | Gindrat | |
| 2018/0310624 | A1* | 11/2018 | Parker | A24C 5/01 |
| 2019/0075848 | A1 | 3/2019 | Worm et al. | |
| 2020/0178599 | A1 | 6/2020 | Worm et al. | |
| 2020/0229485 | A1 | 7/2020 | Gindrat | |

FOREIGN PATENT DOCUMENTS

| | | | | |
|---|---|---|---|---|
| CN | 102762118 | A | 10/2012 | |
| EP | 0 822 670 | A2 | 2/1998 | |
| EP | 2 361 516 | A1 | 8/2011 | |
| JP | 2010-535530 | A | 11/2010 | |
| JP | 2013-519384 | A | 5/2013 | |
| RU | 2 609 394 | C2 | 2/2017 | |
| RU | 2 665 435 | C1 | 8/2018 | |
| WO | WO 95/27411 | A1 | 10/1995 | |
| WO | WO 2009/022232 | A2 | 2/2009 | |
| WO | WO 2009/022232 | A3 | 2/2009 | |
| WO | WO-2011101164 | A1 * | 8/2011 | A24B 15/12 |
| WO | WO 2012/164009 | A2 | 12/2012 | |
| WO | WO 2015/123422 | A1 | 8/2015 | |
| WO | WO 2015/177255 | A1 | 11/2015 | |
| WO | WO 2016/011623 | A1 | 1/2016 | |
| WO | WO 2016/023965 | A1 | 2/2016 | |
| WO | WO 2016/069876 | A1 | 5/2016 | |
| WO | WO 2017/144861 | A1 | 8/2017 | |
| WO | WO 2017/182249 | A1 | 10/2017 | |
| WO | WO 2018/019543 | A1 | 2/2018 | |
| WO | WO 2018/122095 | A1 | 7/2018 | |
| WO | WO-2018235959 | A1 * | 12/2018 | A24C 5/01 |
| WO | WO 2019/030272 | A1 | 2/2019 | |
| WO | WO 2019/030274 | A1 | 2/2019 | |

OTHER PUBLICATIONS

CN-102669810-A, English machine translation (Year: 2012).*

International Search Report and Written Opinion issued on Sep. 14, 2020 in PCT/EP2020/057507 filed Mar. 18, 2020, 17 pages.

Combined Chinese Office Action and Search Report issued Aug. 30, 2023 in Chinese Patent Application No. 202080019213.2 (with English Translation), 21 pages.

Russian Decision to Grant issued Nov. 16, 2023 in Russian Patent Application No. 2021131979/03 (with English Translation), 14 pages.

Combined Russian Office Action and Search Report issued Jul. 3, 2023, in corresponding Russian Patent Application No. 2021131979/03(067715) (with English Translation), 16 pages.

Office Action issued May 13, 2024, in corresponding Japanese Patent Application No. 2021-559533 (with English Translation), 7 pages.

Chinese Office Action issued Nov. 30, 2023 in Chinese Patent Application No. 202080019213.2 (with English Translation), 14 pages.

Yong et al., "Social Organic Chemistry", Fujian Education Press, Mar. 1995, pp. 72-76 (Total 6 pages).

Qingqiu et al., "Pharmaceutical Excipients Application of Color Coating Powder", Chemical Industry Press, May 2000, 18 pages.

Cunzhong, "Smelting and Ingoting of Nonferrous Metals", Metallurgical Industry Press, Oct. 1988, p. 18-23 (total 13 pages).

"Commodity Theory", Dongbei University of Finance and Economics Press, Jun. 2014, pp. 243-246 (total 5 pages).

* cited by examiner

AEROSOL-GENERATING SUBSTRATE COMPRISING AN AEROSOL-GENERATING FILM

The present invention relates to an aerosol-generating substrate formed with an aerosol-generating film, and to an aerosol-generating article incorporating such an aerosol-generating substrate.

Aerosol-generating articles in which an aerosol-generating substrate, such as a nicotine-containing substrate or a tobacco-containing substrate, is heated rather than combusted, are known in the art. Typically, in such heated smoking articles an aerosol is generated by the transfer of heat from a heat source to a physically separate aerosol-generating substrate or material, which may be located in contact with, within, around, or downstream of the heat source. During use of the aerosol-generating article, volatile compounds are released from the aerosol-generating substrate by heat transfer from the heat source and are entrained in air drawn through the aerosol-generating article. As the released compounds cool, they condense to form an aerosol.

A number of prior art documents disclose aerosol-generating devices for consuming aerosol-generating articles. Such devices include, for example, electrically heated aerosol-generating devices in which an aerosol is generated by the transfer of heat from one or more electrical heater elements of the aerosol-generating device to the aerosol-generating substrate of a heated aerosol-generating article.

Substrates for heated aerosol-generating articles have, in the past, often been produced using randomly oriented shreds, strands, or strips of tobacco material. As an alternative, rods for heated aerosol-generating articles formed from gathered sheets of tobacco material have been disclosed, by way of example, in international patent application WO-A-2012/164009.

International patent application WO-A-2011/101164 discloses alternative rods for heated aerosol-generating articles formed from strands of homogenised tobacco material, which may be formed by casting, rolling, calendering or extruding a mixture comprising particulate tobacco and at least one aerosol former to form a sheet of homogenised tobacco material. In alternative embodiments, the rods of WO-A-2011/101164 may be formed from strands of homogenised tobacco material obtained by extruding a mixture comprising particulate tobacco and at least one aerosol former to form continuous lengths of homogenised tobacco material.

Alternative forms of substrates comprising nicotine have also been disclosed. By way of example, liquid nicotine compositions, often referred to as e-liquids, have been proposed. These liquid compositions may, for example, be heated by a coiled electrically resistive filament of an aerosol-generating device.

Substrates of this type may require particular care in the manufacture of the containers holding the liquid composition in order to prevent undesirable leakages. To address this issue and simplify the overall manufacturing process, it has also been proposed to provide a gel composition comprising nicotine that generates a nicotine-containing aerosol upon heating. By way of example, WO-A-2018/019543 discloses a thermoreversible gel composition, that is, a gel that will become fluid when heated to a melting temperature and will set into a gel again at a gelation temperature. The gel is provided within a housing of a cartridge, and the cartridge can be disposed of and replaced when the gel has been consumed.

It would be desirable to provide an aerosol-generating article having a novel aerosol-generating film with improved stability. Additionally, it would be desirable to provide such an aerosol-generating article with an aerosol-generating film that has a high aerosol-former content, such that it can successfully be used as an aerosol-generating substrate. It would be particularly desirable to provide such an aerosol-generating article that is easier to dispose of after use or that has reduced environmental impact. It would be further desirable to provide such an aerosol-generating article that optimises generation of aerosol from the aerosol-generating substrate during use.

The present invention relates to an aerosol-generating article comprising a rod of aerosol-generating substrate comprising an aerosol-generating film. The aerosol-generating film may comprise at least about 25 percent by weight of a polyhydric alcohol. The aerosol-generating film may comprise at least about 10 percent by weight of a cellulose based film-forming agent. The aerosol-generating film may be configured such that the exposed surface area of the aerosol-generating film within the aerosol-generating substrate is at least about 5 square millimetres per mg of the aerosol-generating film. Alternatively or in addition, the aerosol-generating film may be configured such that the bulk density of the aerosol-generating film is at least about 100 mg per cubic centimetre of the aerosol-generating substrate.

According to a first aspect of the present invention there is provided an aerosol-generating article comprising a rod of aerosol-generating substrate, wherein the rod of aerosol-generating substrate comprises: an aerosol-generating film comprising at least 25 percent by weight of a polyhydric alcohol and at least 10 percent by weight of a cellulose based film-forming agent. The aerosol-generating film is configured such that the exposed surface area of the aerosol-generating film within the rod of aerosol-generating substrate is at least about 5 square millimetres per mg of the aerosol-generating film. The aerosol-generating film is preferably substantially tobacco-free.

According to a second aspect of the present invention, there is provided an aerosol-generating article comprising a rod of aerosol-generating substrate, wherein the rod of aerosol-generating substrate comprises: an aerosol-generating film comprising at least about 25 percent by weight of a polyhydric alcohol and at least about 10 percent by weight of a cellulose based film-forming agent. The aerosol-generating film is configured such that the bulk density of the aerosol-generating film is at least about 100 mg per cubic centimetre of the rod of aerosol-generating substrate. The aerosol-generating film is preferably substantially tobacco-free.

According to a third aspect of the present invention, there is provided a rod for use as an aerosol-generating substrate in an aerosol-generating article, the rod comprising: an aerosol-generating film comprising at least about 25 percent by weight of a polyhydric alcohol and at least about 10 percent by weight of a cellulosic film-forming agent, wherein the aerosol-generating film is configured such that the exposed surface area of the aerosol-generating film within the rod of aerosol-generating substrate is at least about 5 square millimetres per mg of the aerosol-generating film. The aerosol-generating film is preferably substantially tobacco-free.

According to a fourth aspect of the present invention, there is provided a rod for use as an aerosol-generating substrate in an aerosol-generating article, the rod comprising: an aerosol-generating film comprising at least about 25 percent by weight of a polyhydric alcohol and at least about 10 percent by weight of a cellulose based film-forming agent, wherein the aerosol-generating film is configured such that the bulk density of the aerosol-generating film is at least about 100 mg per cubic centimetre of the rod of aerosol-generating substrate. The aerosol-generating film is preferably substantially tobacco-free.

According to a fifth aspect of the present invention, there is provided an aerosol-generating system comprising an aerosol-generating article and an electrically operated aerosol-generating device comprising a heater element configured to heat an aerosol-generating substrate of the aerosol-generating article, wherein: the aerosol-generating article comprises a rod of aerosol-generating substrate according to the present invention, as defined above in relation to the third and fourth aspects of the invention. The heater element of the aerosol-generating device is a heater blade or a heater pin configured to be inserted into the rod of aerosol-generating substrate in order to heat the aerosol-generating film.

Any references herein to features of the aerosol-generating article or aerosol-generating substrate according to the present invention should be assumed to apply to all aspects of the present invention, unless stated otherwise.

As used herein, the term "aerosol-generating article" refers to an aerosol-generating article for producing an aerosol comprising an aerosol-generating substrate that is intended to be heated rather than combusted in order to release volatile compounds that can form an aerosol.

As used herein, the term "aerosol-generating substrate" refers to a substrate capable of releasing upon heating volatile compounds, which can form an aerosol. The aerosol generated from aerosol-generating substrates of aerosol-generating articles described herein may be visible or invisible and may include vapours (for example, fine particles of substances, which are in a gaseous state, that are ordinarily liquid or solid at room temperature) as well as gases and liquid droplets of condensed vapours.

Substrates for heated aerosol-generating articles typically comprise an "aerosol former", that is, a compound or mixture of compounds that, in use, facilitates formation of the aerosol, and that preferably is substantially resistant to thermal degradation at the operating temperature of the aerosol-generating article. Examples of suitable aerosol-formers include: polyhydric alcohols, such as propylene glycol, triethylene glycol, 1,3-butanediol and glycerin; esters of polyhydric alcohols, such as glycerol mono-, di- or triacetate; and aliphatic esters of mono-, di- or polycarboxylic acids, such as dimethyl dodecanedioate and dimethyl tetradecanedioate.

The polyhydric alcohol in the aerosol-generating film of the aerosol-generating articles of the invention is also an aerosol former within the meaning set out above.

As used herein, the term "rod" refers to a generally cylindrical element of substantially polygonal cross-section and preferably of circular, oval or elliptical cross-section.

As used herein, the term "film" describes a solid laminar element having a thickness that is less than the width or length thereof.

The film may be self-supporting. In other words, a film may have cohesion and mechanical properties such that the film, even if obtained by casting a film-forming formulation on a support surface, can be separated from the support surface.

Alternatively, the film may be disposed on a support or sandwiched between other materials. This may enhance the mechanical stability of the film.

The "thickness" of the aerosol-generating film of aerosol-generating articles according to the invention corresponds to the minimum distance measured between opposite, substantially parallel surfaces of a film.

The thickness of the aerosol-generating film may substantially correspond to the thickness to which a corresponding film-forming composition is cast or extruded, as the cast or extruded film-forming composition substantially does not contract during drying, despite the loss of water.

The "weight" of the aerosol-generating film of aerosol-generating articles according to the invention will generally correspond to the weight of the components of the corresponding film-forming composition minus the weight of water evaporated during the drying step. If a film is self-supporting, the film can be weighed on its own. If a film is disposed on a support, the film and the support may be weighed and the weight of the support, measured prior to deposition of the film, is subtracted from the combined weight of the film and the support.

Unless stated otherwise, percentages by weight of components of the aerosol-generating film recited herein are based on the total weight of the aerosol-generating film.

As used herein, the term "longitudinal" refers to the direction corresponding to the main longitudinal axis of the aerosol-generating article, which extends between the upstream and downstream ends of the aerosol-generating article. During use, air is drawn through the aerosol-generating article in the longitudinal direction. The term "transverse" refers to the direction that is perpendicular to the longitudinal axis.

Any reference to the "cross-section" of the aerosol-generating article or a component of the aerosol-generating article refers to the transverse cross-section unless stated otherwise. As used herein, the term "length" refers to the dimension of a component in the longitudinal direction and the term "width" refers to the dimension of a component in the transverse direction.

As used herein, the terms "upstream" and "downstream" describe the relative positions of elements, or portions of elements, of the aerosol-generating article in relation to the direction in which the aerosol is transported through the aerosol-generating article during use.

As described above, the present invention provides an aerosol-generating article having a novel aerosol-generating substrate formed with an aerosol-generating film. Upon heating, an aerosol is generated from the aerosol-generating film which is released into the aerosol-generating article and can be drawn through the aerosol-generating article into the consumer's mouth. The aerosol-generating film can be provided instead of, or in addition to, any other aerosol-generating substrate within the aerosol-generating article.

In many embodiments of the present invention, the aerosol-generating film can be configured such that it forms a self-supporting rod and no additional support structures are required within the aerosol-generating substrate. In many cases, the rod of aerosol-generating substrate can be formed from the aerosol-generating film using existing apparatus and methods.

The rod of aerosol-generating substrate incorporating the aerosol-generating film can be readily incorporated into existing constructions of aerosol-generating articles without the need for significant modification and the aerosol-generating articles according to the invention can therefore potentially be manufactured at high speed using existing manufacturing apparatus and methods.

The composition of the aerosol-generating film may be selected such that the majority of the components of the film evaporate upon heating, during use of the aerosol-generating article, leaving minimal residue. This may advantageously provide an aerosol-generating article that is easier to dispose of and has a reduced environmental impact.

The properties and composition of the aerosol-generating film can be readily adapted in order to control the resultant aerosol generated upon heating of the film. The use of the aerosol-generating film also enables a highly consistent aerosol to be provided to the consumer.

Aerosol-generating articles according to the present invention are particularly suitable for use in an aerosol-generating system comprising an electrically heated aerosol-generating device having an internal heater element for heating the rod of aerosol-generating substrate, as described in more detail below. For example, aerosol-generating articles according to the invention find particular application in aerosol-generating systems comprising an electrically heated aerosol-generating device having an internal heater blade which is adapted to be inserted into the aerosol-generating article proximate the rod of aerosol-generating substrate. Aerosol-generating articles of this type are described in the prior art, for example, in European patent application EP-A-0 822 670.

The aerosol-generating films as described herein are particularly suitable for being heated from internally within the aerosol-generating article. When heated by an internal heater element, the aerosol-generating film on the inner surface of the tubular carrier element may shrink, which may advantageously bring the aerosol-generating film closer to the surfaces of the heater element, thereby optimising the heating of the aerosol-generating film.

As used herein, the term "aerosol-generating device" refers to a device comprising a heater element that interacts with the aerosol-generating substrate of the aerosol-generating article to generate an aerosol.

Alternatively, aerosol-generating article according to the invention may comprise a combustible carbon heat source for heating the aerosol-generating substrate during use. Aerosol-generating articles of this type are described in the prior art, for example, in International patent application WO-A-2009/022232.

According to the invention, the aerosol-generating film is configured in such a way as to maximise the total exposed surface area of the aerosol-generating film within the rod of aerosol-generating substrate. By maximising the exposed surface area, it is possible to improve the efficiency of release of aerosol from a given volume of aerosol-generating substrate. The "exposed" surface area of the aerosol-generating film corresponds to the cumulative area of the surfaces that are uncovered and unobstructed within the rod of aerosol-generating substrate and from which volatile components can be freely released upon heating of the aerosol-generating film. During use, the exposed surfaces of the aerosol-generating film may become exposed to the gaseous air flow through the aerosol-generating article.

According to the invention, the total exposed surface area of the aerosol-generating film within the rod of aerosol-generating substrate may be maximised by increasing the exposed surface area per unit weight of the aerosol-generating film. The efficiency of release of aerosol from a given weight of aerosol-generating film can thereby be improved. It may therefore be possible to reduce the total weight of the aerosol-generating film required to produce a desired quantity of aerosol from the rod of aerosol-generating substrate during a heating cycle within an aerosol-generating device.

The exposed surface area of the aerosol-generating film is preferably at least about 5 square millimetres per mg of the aerosol-generating film, more preferably at least about 10 square millimetres per mg of the aerosol-generating film and most preferably at least about 20 square millimetres per mg of the aerosol-generating film.

The exposed surface area of the aerosol-generating film is preferably no more than about 40 square millimetres per mg of the aerosol-generating film, more preferably no more than about 30 square millimetres per mg of the aerosol-generating film. For example, the exposed surface area of the aerosol-generating film may be between about 5 square millimetres and about 40 square millimetres per mg of the aerosol-generating film, or between about 10 square millimetres and about 30 square millimetres per mg of the aerosol-generating film, or between about 20 square millimetres and about 30 square millimetres.

Alternatively or in addition, the total exposed surface area of the aerosol-generating film may be maximised by increasing the bulk density of the aerosol-generating film within the rod of aerosol-generating substrate so that a greater amount of the film, and therefore potentially a larger exposed surface area, can be provided per unit volume of the rod of aerosol-generating substrate. The efficiency of release of aerosol from a given volume of aerosol-generating substrate can thereby be improved. It may therefore be possible to produce a desired quantity of aerosol with a reduced size of aerosol-generating substrate.

The bulk density of the aerosol-generating film within the rod of aerosol-generating substrate is preferably at least about 100 mg per cubic centimetre of the rod of aerosol-generating substrate, more preferably at least about 200 mg per cubic centimetre of the rod of aerosol-generating substrate, more preferably at least about 300 mg per cubic centimetre of the rod of aerosol-generating substrate, most preferably at least about 400 mg per cubic centimetre.

The bulk density of the aerosol-generating film within the rod of aerosol-generating substrate is preferably no more than about 1000 mg per cubic centimetre of the rod of aerosol-generating substrate, more preferably no more than about 850 mg per cubic centimetre, more preferably no more than about 750 mg per cubic centimetre, most preferably no more than about 600 mg per cubic centimetre. For example, the bulk density of the aerosol-generating film within the rod of aerosol-generating substrate may be between about 100 mg and about 1000 mg per cubic centimetre, or between about 200 mg and about 8500 mg per cubic centimetre, or between about 300 mg and about 750 mg per cubic centimetre, or between about 400 mg per cubic centimetre and about 600 mg per cubic centimetre.

The bulk density of the aerosol-generating film corresponds to the total weight of the film provided in the rod of aerosol-generating substrate (in mg), not including the weight of any carrier material, divided by the total volume of the rod (in cubic centimetres).

The present invention encompasses a variety of different configurations of the aerosol-generating film to provide an increased total exposed surface area.

In certain preferred embodiments, the rod of aerosol-generating substrate comprises a plurality of stacked layers of the aerosol-generating film.

As used herein, the term "stacked" refers to the arrangement of the plurality of layers of aerosol-generating film one over another. In the present invention, the "stacked" layers may be arranged one over another with spacing between adjacent layers. Alternatively, adjacent layers may be at least partially in contact with each other so that the layers are spaced apart in some areas whilst in other areas the spacing between the adjacent layers may approach zero. The term "stacked" is used herein irrespective of the orientation of the stacked layers.

The provision of a plurality of stacked layers of the aerosol-generating film advantageously provides a relatively high exposed surface area of the film, since the surface of the aerosol-generating film on both sides of each layer may be exposed. The exposed surface area can be readily increased by increasing the number of layers within the stack.

The regular arrangement of the plurality of layers advantageously provides the rod with a consistent distribution of the aerosol-generating film and a consistent resistance to draw. The resistance to draw of the rod can be readily controlled through the adjustment of the spacing of the layers and the thickness of the layers. The regular arrangement of the plurality of layers can also optimise heat transfer from a heater element that is in contact with the rod during use through the rod.

The plurality of layers of the aerosol-generating film may be stacked such that each layer extends in the longitudinal direction of the aerosol-generating article. Preferably, the layers are spaced apart from each other in the transverse direction to enable the flow of air through the rod during use. This arrangement of the layers with transverse spacing between adjacent layers may facilitate the insertion of a heater element, such as a heater blade, into the rod.

In such embodiments having a plurality of longitudinally extending layers, preferably, at least about 80 percent of the plurality of layers extends substantially the entire length of the rod, more preferably at least about 90 percent of the plurality of layers and more preferably at least about 95 percent of the plurality of layers. Particularly preferably, each of the plurality of layers extends substantially the entire length of the rod. A layer that extends substantially the entire length of the rod extends substantially all of the way between the upstream end and the downstream end of the rod. Such an arrangement provides better control over the resistance to draw of the rod and therefore the aerosol delivery. The relative widths of the plurality of layers may be varied in order to provide varying arrangements of the stacked layers. For example, at least two layers may have a different width to each other. Alternatively, the plurality of layers have a substantially constant width.

In such embodiments having a plurality of longitudinally extending layers, the plurality of layers are preferably arranged substantially parallel to each other to provide a substantially constant transverse spacing of the layers along the length of the rod. The transverse spacing between the layers may be adapted in order to provide the desired level of air flow and therefore the desired resistance to draw of the rod. Preferably, the layers are spaced apart from each other in a transverse direction by at least about 10 microns, more preferably at least about 20 microns and most preferably at least about 50 microns. Preferably, the layers are preferably spaced apart from each other in a transverse direction by no more than about 300 microns, more preferably no more than about 200 microns and most preferably no more than about 150 microns.

Alternatively, the plurality of layers of the aerosol-generating film may be stacked such that each layer extends in the transverse direction of the aerosol-generating article. The stack of layers therefore extends along the length of the rod. Preferably, the transverse layers of aerosol-generating film are adapted to allow a flow of air in a longitudinal direction through the rod during use. For example, each of the layers may be provided with one or more holes or cut outs through the layer.

In such embodiments having a plurality of transverse layers of aerosol-generating film, the layers are preferably spaced apart from each other in a longitudinal direction in order to maximise the exposed surfaces of the layers. In this case, the layers are preferably spaced apart from each other by at least about 50 microns, more preferably at least about 100 microns and most preferably at least about 150 microns. Preferably, the layers are preferably spaced apart from each other in a longitudinal direction by no more than about 1500 microns, more preferably no more than about 800 microns and most preferably no more than about 600 microns. Alternatively, the layers may be stacked such that adjacent layers are at least partially in contact with each other, with substantially no longitudinal spacing between them.

The following further discussion of the embodiments of the invention comprising a plurality of stacked layers of the aerosol-generating film applies to all arrangements of the layers as described above.

The number of layers of aerosol-generating film stacked within the rod can be varied depending on the thickness of the layers and the length of the rod. The number of layers can be increased in order to increase the total exposed surface area of the aerosol-generating film. Preferably, the rod comprises between about 2 and about 50 stacked layers of aerosol-generating film.

The plurality of layers of the aerosol-generating film may all have substantially the same thickness as each other. Alternatively, the plurality of layers may include layers of at least two different thicknesses.

In certain preferred embodiments of the present invention, the plurality of stacked layers of the aerosol-generating film are mounted within a tubular carrier element, such as a paper or cardboard tube. In alternative embodiments, the plurality of stacked layers are circumscribed by a wrapper. By providing the stacked layers within a tubular carrier layer or a wrapper, the aerosol-generating film can be more conveniently combined with other components to form the aerosol-generating article.

In alternative embodiments of the present invention, the rod of aerosol-generating substrate comprises one or more gathered layers of the aerosol-generating film. As used herein with reference to the invention, the term "gathered" describes a layer that is convoluted, folded, or otherwise compressed or constricted substantially transversely to the longitudinal axis of the aerosol-generating article.

The use of one or more gathered layers of the aerosol-generating film is an alternative way to provide a relatively high exposed surface area within the rod of aerosol-generating substrate. The exposed surface area of the aerosol-generating film and also the bulk density of the aerosol-generating film within the rod can be readily controlled by adapting the degree of convolution or folding of the layers.

Preferably, the one or more gathered layers of the aerosol-generating film are circumscribed by a wrapper. Preferably, the one or more gathered layers of the aerosol-generating film extend along substantially the entire length of the rod and across substantially the entire transverse cross-sectional area of the rod.

In further alternative embodiments of the present invention, the rod of aerosol-generating substrate comprises a plurality of strips or shreds of the aerosol-generating film. For example, the rod may be formed of a plurality of strips of aerosol-generating film that are aligned in the longitudinal direction and have been brought together and wrapped to form a rod of aerosol-generating substrate. Alternatively, the strips of aerosol-generating film may be randomly oriented within the rod. The use of a plurality of strips or shreds is a further way in which the total exposed surface area of the aerosol-generating film can be increased. The exposed surface area of the aerosol-generating film and also the bulk density of the aerosol-generating film within the rod can be readily controlled by adapting the number of strips within the volume of the rod.

In such embodiments, the strips of aerosol-generating film preferably have a length of between about 10 millimetres and about 20 millimetres, more preferably between about 12 millimetres and about 18 millimetres, more preferably between about 14 millimetres and about 16 millimetres, more preferably about 15 millimetres. Alternatively or in addition, the strips of aerosol-generating film preferably have a width of between about 0.4 millimetres and about 0.8 millimetres.

In further embodiments of the present invention, the rod of aerosol-generating substrate may comprise a plurality of hollow beads formed of the aerosol-generating film, for example, a plurality of spherical beads. The use of a plurality of beads is a further way in which the total exposed surface area of the aerosol-generating film can be increased. The exposed surface area of the aerosol-generating film and also the bulk density of the aerosol-generating film within the rod can be readily controlled by adapting the number of beads within the rod and the packing density of the beads.

The rod of aerosol-generating substrate may comprise between about 2 and about 30 beads of the aerosol-generating film. The plurality of beads are preferably provided within a cavity of a tubular carrier element, so that they can be contained within the aerosol-generating substrate.

In any of the embodiments of the present invention, the aerosol-generating film may advantageously be textured over at least part of its surface. As used herein the term "textured" refers to a film that has been crimped, embossed, debossed, perforated or otherwise locally deformed. For example, the film may comprise a plurality of spaced-apart indentations, protrusions, perforations or a combination thereof. Texture may be provided on one side of the film or on both sides the film. Where a plurality of stacked layers of the aerosol-generating film are provided, some or all of the layers may be textured.

The provision of texture over at least part of the surface of the aerosol-generating film is an alternative or additional way by which the exposed surface area of the aerosol-generating film can be maximised.

In certain preferred embodiments, the aerosol-generating film is crimped over at least a part of its surface. As used herein, the term "crimped" denotes a film having a plurality of substantially parallel ridges or corrugations. Preferably, when the aerosol-generating article has been assembled, the substantially parallel ridges or corrugations extend along or parallel to the longitudinal axis of the aerosol-generating article.

A single crimped layer of aerosol-generating film may be provided in the rod of aerosol-generating substrate. In such embodiments, the single crimped layer is preferably gathered as described above. Alternatively, a plurality of crimped layers of aerosol-generating film may be provided. For example, a plurality of crimped layers of aerosol-generating film may be stacked to form the rod of aerosol-generating substrate, as described above.

The thickness of the aerosol-generating film in the aerosol-generating articles according to the present invention is preferably at least about 0.05 millimetres, more preferably at least about 0.1 millimetres, most preferably at least about 0.15 millimetres. The thickness of the aerosol-generating film is preferably no more than about 1.0 millimetre, more preferably no more than about 0.5 millimetres, most preferably no more than about 0.3 millimetres. For example, the thickness of the film may be between about 0.05 millimetres and about 1.0 millimetres, or between about 0.1 millimetres and about 0.5 millimetres, or between about 0.15 millimetres and about 0.3 millimetres. The present invention therefore provides a relatively thin layer of the aerosol-generating film so that the ratio of the surface area to the weight of the film can be maximised. This improves the efficiency of release of the volatile components from the aerosol-generating film upon heating. The use of a relatively thin layer of the aerosol-generating film also enables the weight of the film to be kept low whilst retaining a sufficient surface area. This advantageously decreases the thermal inertia of the aerosol-generating film, to further improve the efficiency of aerosol generation.

The weight of the aerosol-generating film in the rod of aerosol-generating substrate may also be adapted depending on the desired level of aerosol delivery during use. Preferably, the weight of the aerosol-generating film is selected such that substantially all of the volatile components of the aerosol-generating film are released during a typical heating cycle of the aerosol-generating article, in order to minimise waste and maximise degradability of the rod of aerosol-generating substrate.

Preferably, the tubular carrier element provides at least about 20 milligrams of the aerosol-generating film, more preferably at least about 50 milligrams, more preferably at least about 100 milligrams. Preferably, the tubular carrier element provides no more than about 300 milligrams of the aerosol-generating film, more preferably no more than about 200 milligrams. For example, the tubular carrier element may provide between about 20 milligrams and about 300 milligrams of the aerosol-generating film, or between about 50 milligrams and about 200 milligrams of the aerosol-generating film, or between about 100 milligrams and about 200 milligrams of the aerosol-generating film.

The aerosol-generating film preferably has a basis weight of at least about 100 grams per square metre, more preferably at least about 120 grams per square metre, most preferably at least about 140 grams per square metre. Preferably, the aerosol-generating film has a basis weight of no more than 300 grams per square metre, more preferably no more than 280 grams per square metre, most preferably no more than 260 grams per square metre. For example, the aerosol-generating film may have a basis weight of between about 100 grams per square metre and about 300 grams per square metre, or between about 120 grams per square metre and about 280 grams per square metre, or between about 140 grams per square metre and about 260 grams per square metre.

The rod of aerosol-generating substrate preferably has an external diameter that is approximately equal to the external diameter of the aerosol-generating article.

Preferably, the rod of aerosol-generating substrate has an external diameter of at least 5 millimetres. The rod of aerosol-generating substrate may have an external diameter of between about 5 millimetres and about 12 millimetres, for example of between about 5 millimetres and about 10 millimetres or of between about 6 millimetres and about 8 millimetres. In a preferred embodiment, the rod of aerosol-generating substrate has an external diameter of about 7 millimetres.

The rod of aerosol-generating substrate may have a length of between about 5 millimetres and about 15 mm. In one embodiment, the rod of aerosol-generating substrate may have a length of about 10 millimetres. In a preferred embodiment, the rod of aerosol-generating substrate has a length of about 12 millimetres.

Preferably, the rod of aerosol-generating substrate has a substantially uniform cross-section along the length of the rod. Particularly preferably, the rod of aerosol-generating substrate has a substantially circular cross-section.

The aerosol-generating film may be incorporated directly into the rod of aerosol-generating substrate as a single layer substrate. The single layer aerosol-generating film may be textured as described above. Alternatively, the aerosol-generating film may be coated or infiltrated onto a carrier layer, such as a layer of a porous or fibrous sheet material, before being incorporated into the rod of aerosol-generating substrate. Suitable sheet materials for the carrier layer include but are not limited to paper, cardboard and homogenised plant material. The carrier layer with the aerosol-generating film applied may be textured, as described above.

The aerosol-generating film of aerosol-generating articles according to the present invention has a composition comprising at least about 25 percent by weight of a polyhydric alcohol, more preferably at least about 30 percent by weight of a polyhydric alcohol, more preferably at least about 35 percent by weight of a polyhydric alcohol, more preferably, at least about 40 percent by weight of a polyhydric alcohol.

Preferably, the aerosol-generating film preferably comprises less than about 90 percent by weight of a polyhydric alcohol, more preferably less than about 80 percent by weight of a polyhydric alcohol, more preferably less than about 70 percent by weight of the polyhydric alcohol, more preferably less than about 60 percent by weight of a polyhydric alcohol.

For example, the aerosol-generating film may comprise between about 25 percent by weight and about 90 percent by weight of the polyhydric alcohol, or between about 30 percent by weight and about 80 percent by weight of the polyhydric alcohol, or between about 35 percent by weight and about 70 percent by weight of the polyhydric alcohol, or between about 40 percent by weight and about 60 percent by weight of the polyhydric alcohol.

Polyhydric alcohols suitable for use in the aerosol-generating film include, but are not limited to, propylene glycol, triethylene glycol, 1,3-butanediol, and glycerin. Preferably, in an aerosol-generating film in accordance with the invention the polyhydric alcohol is selected from the group consisting of glycerin, propylene glycol, and combinations thereof. In particularly preferred embodiments the polyhydric alcohol is glycerin.

Thus, the invention advantageously provides a film having a significant polyhydric alcohol content that can easily be cast or extruded and solidified starting from a composition having a gel-like texture. As significant percentages of the polyhydric alcohol, particularly glycerin, can be provided in film form, whilst at the same time being able to finely control the geometry of the film, the invention advantageously provides a film that is particularly suitable for use an aerosol-generating substrate in an aerosol-generating article designed to be heated to release the aerosol.

Preferably, the aerosol-generating film further comprises at least about 3 percent by weight of a cellulose based film-forming agent, more preferably at least about 6 percent by weight of a cellulose based film-forming agent, more preferably at least about 10 percent by weight of a cellulose based film-forming agent, more preferably at least about 14 percent by weight of a cellulose based film-forming agent, more preferably at least about 16 percent by weight of a cellulose based film-forming agent, more preferably at least about 18 percent by weight of a cellulose based film-forming agent.

The aerosol-generating film may comprise up to about 70 percent by weight of a cellulose based film-forming agent. Preferably, the aerosol-generating film preferably comprises no more than about 26 percent by weight of the cellulose based film-forming agent, more preferably no more than about 24 percent by weight of the cellulose based film-forming agent, more preferably no more than about 22 percent by weight of the cellulose based film-forming agent.

For example, the aerosol-generating film may comprise between about 3 percent by weight and about 70 percent by weight of a cellulose based film-forming agent, or between about 6 percent by weight and about 26 percent by weight of a cellulose based film-forming agent, or between about 10 percent by weight and about 24 percent by weight of a cellulose based film-forming agent, or between about 14 percent by weight and about 24 percent by weight of a cellulose based film-forming agent, or between about 16 percent by weight and about 22 percent by weight of a cellulose based film-forming agent, or between about 18 percent by weight and about 22 percent by weight of a cellulose based film-forming agent.

In the context of the present invention the term "cellulose based film-forming agent" is used to describe a cellulosic polymer capable, by itself or in the presence of an auxiliary thickening agent, of forming a continuous film.

Preferably, the cellulose based film-forming agent is selected from the group consisting of hydroxypropyl methylcellulose (HPMC), methylcellulose (MC), ethylcellulose (EC), hydroxyethyl methyl cellulose (HEMC), hydroxyethyl cellulose (HEC), hydroxypropyl cellulose (HPC) and combinations thereof. In particularly preferred embodiment, the cellulose based film-forming agent is HPMC.

Preferably, in the aerosol-generating film a ratio between the weight of cellulose based film-forming agent and the weight of polyhydric alcohol is at least about 0.1, more preferably at least about 0.2, even more preferably about 0.3. In addition, or as an alternative, in the aerosol-generating film a ratio between the weight of cellulose based film-forming agent and the weight of polyhydric alcohol is preferably less than or equal to about 1.

In preferred embodiments, in the aerosol-generating film a ratio between the weight of cellulose based film-forming agent and the weight of polyhydric alcohol is from about 0.1 to about 1.

The inventors have surprisingly found that aerosol-generating films that comprise at least 6 percent by weight of a cellulose based film-forming agent, and preferably HPMC, are especially stable. Thus, they substantially maintain their shape when exposed to a variety of environmental conditions, such as a change in relative humidity from 10 percent to 60 percent. Accordingly, aerosol-generating films as described above advantageously do not release a liquid phase during storage or transportation.

Preferably, the aerosol-generating film further comprises at least about 1 percent by weight of a non-cellulose based thickening agent, more preferably at least about 2 percent by weight of the non-cellulose based thickening agent, more preferably at least about 3 percent by weight of the non-cellulose based thickening agent. Preferably, the aerosol-generating film preferably comprises no more than about 10 percent by weight of the non-cellulose based thickening agent, more preferably no more than about 8 percent by weight of the non-cellulose based thickening agent, more preferably no more than about 6 percent by weight of the non-cellulose based thickening agent. For example, the aerosol-generating film may comprise between about 1 percent by weight and about 10 percent by weight of the non-cellulose based thickening agent, or between about 2 percent by weight and about 8 percent by weight of the non-cellulose based thickening agent, or between about 3 percent by weight and about 6 percent by weight of the non-cellulose based thickening agent.

As used herein with reference to the invention, the term "non-cellulose based thickening agent" is used to describe a non-cellulosic substance that, when added to an aqueous or non-aqueous liquid composition, increases the viscosity of the liquid composition without substantially modifying its other properties. The thickening agent may increase stability, and improve suspension of components in the liquid composition. A thickening agent may also be referred to as a "thickener" or a "rheology modifier".

Preferably, in an aerosol-generating film in accordance with the invention the non-cellulose based thickening agent is selected from the group consisting of agar, xanthan gum, gum Arabic, guar gum, locust bean gum, pectin, carrageenan, starch, alginate, and combinations thereof. In preferred embodiments, the non-cellulose based thickening agent is agar.

Preferably, in the aerosol-generating film a ratio between the weight of non-cellulose based thickening agent and the weight of polyhydric alcohol is at least about 0.05, more preferably at least 0.1, even more preferably at least 0.2. In addition, or as an alternative, in the aerosol-generating film a ratio between the weight of non-cellulose based thickening agent and the weight of polyhydric alcohol is preferably less than or equal to about to 0.5.

In preferred embodiments, in the aerosol-generating film a ratio between the weight of non-cellulose based thickening agent and the weight of polyhydric alcohol is from about 0.1 to about 0.5.

The inventors have surprisingly found that incorporation of a combination of a cellulose based film-forming agent and a non-cellulose based thickening agent into the film together with the polyhydric alcohol may provide a film having improved stability that can be produced with high precision and repeatability.

Preferably, the aerosol-generating film comprises less than about 30 percent by weight water. More preferably, the aerosol-generating film comprises between about 10 percent by weight and about 20 percent by weight water.

In some embodiments, the aerosol-generating film further comprises an alkaloid compound or a cannabinoid compound or both.

As used herein with reference to the invention, the term "alkaloid compound" describes any one of a class of naturally occurring organic compounds that contain one or more basic nitrogen atoms. Generally, an alkaloid contains at least one nitrogen atom in an amine-type structure. This or another nitrogen atom in the molecule of the alkaloid compound can be active as a base in acid-base reactions. Most alkaloid compounds have one or more of their nitrogen atoms as part of a cyclic system, such as for example a heterocylic ring. In nature, alkaloid compounds are found primarily in plants, and are especially common in certain families of flowering plants. However, some alkaloid compounds are found in animal species and fungi. In the context of the present invention, the term "alkaloid compounds" is used to describe both naturally derived alkaloid compounds and synthetically manufactured alkaloid compounds.

Preferably, the alkaloid compound is selected from the group consisting of nicotine, anatabine and combinations thereof.

As used herein with reference to the invention, the term "cannabinoid compound" describes any one of a class of naturally occurring compounds that are found in parts of the cannabis plant—namely the species *Cannabis sativa, Cannabis indica*, and *Cannabis ruderalis*. Cannabinoid compounds are especially concentrated in the female flower heads. Cannabinoid compounds naturally occurring the in cannabis plant include tetrahydrocannabinol (THC) and cannabidiol (CBD). In the context of the present invention, the term "cannabinoid compounds" is used to describe both naturally derived cannabinoid compounds and synthetically manufactured cannabinoid compounds.

Preferably, the cannabinoid compound is selected from the group consisting of: tetrahydrocannabinol (THC), tetrahydrocannabinolic acid (THCA), cannabidiol (CBD), cannabidiolic acid (CBDA), cannabinol (CBN), cannabigerol (CBG), cannabigerol monomethyl ether (CBGM), cannabivarin (CBV), cannabidivarin (CBDV), tetrahydrocannabivarin (THCV), cannabichromene (CBC), cannabicyclol (CBL), cannabichromevarin (CBCV), cannabigerovarin (CBGV), cannabielsoin (CBE), cannabicitran (CBT) and combinations thereof.

In general, the aerosol-generating film may comprise up to about 10 percent by weight of an alkaloid compound or a cannabinoid compound or both. The content of alkaloid compound or cannabinoid compound or both in the film may be increased and adjusted with a view to optimising the delivery of alkaloid compound or cannabinoid compound or both in aerosol form to the consumer. Compared with existing aerosol-generating substrates based on the use of plant material, this may advantageously allow for higher contents of alkaloid compound or cannabinoid compound or both per volume of substrate (film) or per weight of substrate (film), which may be desirable from a manufacturing viewpoint.

Preferably, the aerosol-generating film comprises at least about 0.5 percent by weight of an alkaloid compound or a cannabinoid compound or both. Thus, the aerosol-generating film preferably comprises at least about 0.5 percent by weight of an alkaloid compound or at least 0.5 percent by weight of a cannabinoid compound or at least about 0.5 percent by weight of a combination of an alkaloid compound and a cannabinoid compound.

More preferably, the aerosol-generating film comprises at least about 1 percent by weight of an alkaloid compound or a cannabinoid compound or both, more preferably at least about 2 percent by weight of an alkaloid compound or a cannabinoid compound or both. The aerosol-generating film preferably comprises less than about 6 percent by weight of an alkaloid compound or a cannabinoid compound or both, more preferably less than about 5 percent by weight of an alkaloid compound or a cannabinoid compound or both, more preferably less than about 4 percent by weight of an alkaloid compound or a cannabinoid compound or both.

For example, the aerosol-generating film may comprise from about 0.5 percent by weight to about 10 percent by weight of an alkaloid compound or a cannabinoid compound or both, or from about 1 percent by weight to about 6 percent by weight of an alkaloid compound or a cannabinoid compound or both, or from about 2 percent by weight to about 5 percent by weight of an alkaloid compound or a cannabinoid compound or both.

In some embodiments, the aerosol-generating film comprises one or more of a cannabinoid and an alkaloid compound comprising nicotine or anatabine. In some preferred embodiments, the aerosol-generating film comprises nicotine. As used herein with reference to the invention, the term "nicotine" is used to describe nicotine, a nicotine base or a nicotine salt. In embodiments in which the aerosol-generating film comprises a nicotine base or a nicotine salt, the amounts of nicotine recited herein are the amount of free base nicotine or amount of protonated nicotine, respectively.

The aerosol-generating film may comprise natural nicotine or synthetic nicotine.

The aerosol-generating film may comprise one or more monoprotic nicotine salts.

As used herein with reference to the invention, the term "monoprotic nicotine salt" is used to describe a nicotine salt of a monoprotic acid.

Preferably, the aerosol-generating film comprises at least about 0.5 percent by weight nicotine. More preferably, the aerosol-generating film comprises at least about 1 percent by weight nicotine. Even more preferably, the aerosol-generating film comprises at least about 2 percent by weight nicotine. In addition, or as an alternative, the aerosol-generating film preferably comprises less than about 10 percent by weight nicotine. More preferably, the aerosol-generating film comprises less than about 6 percent by weight nicotine. Even more preferably, the aerosol-generating film comprises less than about 5 percent by weight nicotine. For example, the aerosol-generating film may comprise between about 0.5 percent by weight and about 10 percent by weight nicotine, or between about 1 percent by weight and about 6 percent by weight nicotine, or between about 2 percent by weight and about 5 percent by weight nicotine.

In some preferred embodiments, the aerosol-generating film comprises a cannabinoid compound. Preferably, the cannabinoid compound is selected from CBD and THC. More preferably, the cannabinoid compound is CBD.

The aerosol-generating film may comprise up to about 10 percent by weight of CBD. Preferably, the aerosol-generating film comprises at least about 0.5 percent by weight CBD, more preferably at least about 1 percent by weight CBD, more preferably at least about 2 percent by weight CBD. Preferably, the aerosol-generating film preferably comprises less than about 6 percent by weight CBD, more preferably less than about 5 percent by weight CBD, more preferably less than about 4 percent by weight CBD.

For example, the aerosol-generating film may comprise from about 0.5 percent by weight to about 10 percent by weight CBD, more preferably from about 1 percent by weight to about 6 percent by weight CBD, even more preferably from about 2 percent by weight to about 5 percent by weight CBD.

The aerosol-generating film may be a substantially tobacco-free aerosol-generating film.

As used herein with reference to the invention, the term "substantially tobacco-free aerosol-generating film" describes an aerosol-generating film having a tobacco content of less than 1 percent by weight. For example, the aerosol-generating film may have a tobacco content of less than about 0.75 percent by weight, less than about 0.5 percent by weight or less than about 0.25 percent by weight.

The aerosol-generating film may be a tobacco-free aerosol-generating film.

As used herein with reference to the invention, the term "tobacco-free aerosol-generating film" describes an aerosol-generating film having a tobacco content of 0 percent by weight.

In some embodiments, the aerosol-generating film comprises tobacco material or a non-tobacco plant material or a plant extract. By way of example, the aerosol-generating film may comprise tobacco particles, such as tobacco lamina particles, as well as particles of other botanicals, such as clove and eucalyptus. Where the aerosol-generating film comprises tobacco, the tobacco content is preferably no more than about 70 percent by weight, more preferably no more than about 50 percent by weight, more preferably no more than about 30 percent by weight and most preferably no more than about 10 percent by weight.

In preferred embodiments, the aerosol-generating film comprises an acid. More preferably, the aerosol-generating film comprises one or more organic acids. Even more preferably, the aerosol-generating film comprises one or more carboxylic acids. In particularly preferred embodiments, the acid is lactic acid or levulinic acid.

The inclusion of an acid is especially preferred in embodiments of the aerosol-generating film comprising nicotine, as it has been observed that the presence of an acid may stabilise dissolved species in the film-forming composition, such as with nicotine and other plant extracts. Without wishing to be bound by theory, it is understood that the acid may interact with the nicotine molecule, especially where nicotine is provided in salt form, and this substantially prevents nicotine from evaporating during the drying operation. As such, the loss of nicotine during manufacturing of the film can be minimised, and higher, better controlled nicotine delivery to the consumer can advantageously be ensured.

Preferably, the aerosol-generating film comprises at least about 0.25 percent by weight of the acid. More preferably, the aerosol-generating film comprises at least about 0.5 percent by weight of the acid. Even more preferably, the aerosol-generating film comprises at least about 1 percent by weight of the acid. In addition, or as an alternative, the aerosol-generating film preferably comprises less than about 3.5 percent by weight of the acid. More preferably, the aerosol-generating film comprises less than about 3 percent by weight of the acid. Even more preferably, the aerosol-generating film comprises less than about 2.5 percent by weight of the acid.

For example, the aerosol-generating film may comprise between about 0.25 percent by weight and about 3.5 percent by weight of the acid, or between about 0.5 percent by weight and about 3 percent by weight of the acid, or between about 1 percent by weight and about 2.5 percent by weight of the acid.

The aerosol-generating film may optionally comprise a flavourant. In some embodiments, the aerosol-generating film may comprise up to about 2 percent by weight of a flavourant. By way of example, the aerosol-generating film may comprise one or more of: menthol, terpenes, terpenoids, eugenol and eucalyptol.

The aerosol-generating film may be produced by forming a film-forming composition of the components of the film, preferably an aqueous film-forming composition, casting or extruding the film-forming composition onto a support surface, leaving the film-forming composition to gellify and then drying the film-forming composition to obtain an aerosol-generating film. The film may then be detached from the support surface and incorporated into an aerosol-generating substrate for an aerosol-generating article. Alternatively, the film may be incorporated into an aerosol-generating substrate together with the support surface.

Upon heating, most of the components of the aerosol-generating film are found to evaporate. In effect, it has been observed that only some residue of the cellulose based film-forming agent, where present, is typically left following use. As such, aerosol-generating articles incorporating substrates comprising an aerosol-generating film as described may be easier to dispose of, and may have an improved environmental impact.

During use, the aerosol-generating film may be heated to a temperature of between about 180 degrees Celsius to about 250 degrees Celsius in order to generate an aerosol. The inventors have surprisingly found that when the aerosol-generating film is heated in an aerosol-generating device, it may release polyhydric alcohol without substantially releasing a liquid phase.

The aerosol-generating articles according to the invention preferably comprise one or more elements in addition to the rod of aerosol-generating substrate, wherein the rod and the one or more elements are assembled within a substrate wrapper or inside a tubular carrier element.

Preferably, the aerosol-generating article further comprises a flow restriction element downstream of the rod of aerosol-generating substrate. The flow restriction element may advantageously be incorporated in order to provide the aerosol-generating article with an acceptable level of resistance to draw (RTD). Suitable flow restriction elements for providing a desired level of RTD would be known to the skilled person. In some embodiments, the flow restriction element may a constriction, such as one or more holes having a diameter that is smaller than the diameter of the internal cavity. In preferred embodiments, the flow restriction element comprises one or more plugs of fibrous filtration material, such as one or more cellulose acetate plugs.

The resistance to draw (RTD) of the aerosol-generating article after insertion of a heater element is preferably between about 40 mm WG and about 140 mm WG, more preferably between about 80 mm WG and about 120 mm WG.

As used herein, resistance to draw is expressed with the units of pressure 'mm WG' or 'mm of water gauge' and is measured in accordance with ISO 6565:2002.

The flow restriction element may extend to the downstream end of the aerosol-generating article. Alternatively, a hollow mouth end cavity may be provided downstream of the flow restriction element.

The flow restriction element preferably extends longitudinally between about 15 millimetres and about 25 millimetres along the aerosol-generating article.

Preferably, the flow restriction element is spaced apart from the rod of aerosol-generating substrate in a longitudinal direction such that the flow restriction element and the rod of aerosol-generating substrate are separated by a hollow space, or cavity. This separation of the components advantageously provides space for the formation of the aerosol within the aerosol-generating article. Preferably, the longitudinal spacing between the flow restriction element and the aerosol-generating film is at least about 10 percent of the length of the aerosol-generating article, more preferably at least about 20 percent of the length. Preferably, the length of the space between the aerosol-generating film and the flow restriction element is at least 50 percent of the length of the rod of aerosol-generating substrate.

Preferably, the aerosol-generating article further comprises an upstream sealing element covering the upstream end of the rod of aerosol-generating substrate. The sealing of the upstream end advantageously reduces the ingress of air and water into the rod of aerosol-generating substrate prior to use. This helps to retain the freshness of the aerosol-generating film during storage in order to optimise the delivery of aerosol upon heating. Furthermore, the sealing of the upstream end of the rod of aerosol-generating substrate may reduce the loss of the volatile components of the aerosol-generating film during storage, so that the delivery of these components to the consumer can be maximised.

The upstream sealing element may take any suitable form but is preferably in the form of a sheet of material that covers the upstream face of the rod of aerosol-generating substrate. Preferably, the sheet of material is substantially impermeable. The upstream sealing element may be formed of any suitable sheet material, including but not limited to paper, aluminium, polymer, or combinations thereof.

Preferably, a frangible upstream sealing element is provided. The sealing element is frangible such that it can be pierced by a heater element or other piercing means upon insertion of the aerosol-generating article into an aerosol-generating device. A support element, such as a plug of fibrous filtration material may be provided directly behind the frangible upstream sealing element, if desired, in order to facilitate the piercing of the frangible upstream sealing element by the heater element or other piercing means.

Alternatively or in addition to an upstream sealing element, the aerosol-generating article may further comprise a downstream sealing element at the downstream end thereof. The downstream sealing element may be the same or a different form to the upstream sealing element. Where a downstream sealing element is provided, it may be removable such that it can be removed from the aerosol-generating article prior to use.

Alternatively or in addition to the provision of an upstream sealing element, a tubular support element may be provided at the upstream end of the aerosol-generating article, upstream of the rod of aerosol-generating substrate. For example, a hollow acetate tube may be provided upstream of the rod of aerosol-generating substrate, at the upstream end of the aerosol-generating article. The tubular support element may advantageously minimise the risk of loss of any of the aerosol-generating film from the aerosol-generating article prior to use. Furthermore, the tubular support element may facilitate the insertion and removal of an internal heater element into the aerosol-generating article during use of the aerosol-generating article in an aerosol-generating device. Furthermore, the tubular support element may be used to direct or control airflow through the aerosol-generating article.

As defined above, the third and fourth aspects of the present invention provide rods for use as an aerosol-generating substrate for an aerosol-generating article, wherein the rod comprises an aerosol-generating film. The rod of aerosol-generating substrate and the aerosol-generating film may have any of the features or properties described above in relation to the first and second aspects of the invention.

The rods of aerosol-generating substrate according to the third aspect of the invention, as described above, may be produced using a method according to the invention, as defined below. The method according to the invention comprises a first step of providing an aqueous film forming composition comprising polyhydric alcohol and cellulose based film forming agent and a second step of providing a sheet material. In a third step, the aqueous film-forming composition is applied onto the surface of the sheet material to form a film layer and in a fourth step, the film layer is dried to form an aerosol-generating film having at least 25 percent by weight polyhydric alcohol and at least 10 percent by weight cellulose based film forming agent. In a fifth step, the film layer is configured to form a rod of aerosol-generating substrate such that the exposed surface area of the aerosol-generating film is at least about 5 square millimetres per mg of the aerosol-generating film.

The rods of aerosol-generating substrate according to the fourth aspect of the invention, as described above, may be produced using a method according to the invention, as defined below. The method according to the invention comprises a first step of providing an aqueous film forming composition comprising polyhydric alcohol and cellulose based film forming agent and a second step of providing a sheet material. In a third step, the aqueous film-forming composition is applied onto the surface of the sheet material to form a film layer and in a fourth step, the film layer is dried to form an aerosol-generating film having at least about 40 percent by weight polyhydric alcohol and at least about 10 percent by weight cellulose based film forming agent. In a fifth step, the film layer is configured to form a rod of aerosol-generating substrate such that the bulk density of the aerosol-generating film is at least about 100 mg per cubic centimetre of the rod of aerosol-generating substrate.

In any of the methods according to the present invention, the step of configuring will depend upon the desired configuration of the aerosol-generating film within the rod of aerosol-generating substrate. For example, where it is desired to form a rod of aerosol-generating substrate comprising a plurality of stacked layers of the aerosol-generating film, as described above, the step of configuring the aerosol-generating film may comprise the step of forming a plurality of layers of the aerosol-generating film and stacking the plurality of layers to form the rod. Alternatively, the step of configuring the aerosol-generating film may comprise gathering the aerosol-generating film to form a rod. Alternatively, the step of configuring the aerosol-generating film may comprise cutting a plurality of strips from the film layer and forming the plurality of strips in to a rod.

As described above, the present invention further provides an aerosol-generating system comprising an aerosol-generating article including a rod of aerosol-generating substrate according to the invention, in combination with an electrically operated aerosol-generating device which is adapted to receive the aerosol-generating article and which has a heater element configured to heat the aerosol-generating film of the rod of aerosol-generating substrate. The aerosol-generating article comprises an aerosol-generating substrate according to the third or fourth aspects of the invention, as described in detail above.

Preferably, the heater element is configured to heat the aerosol-generating film to a temperature of between about 120 degrees Celsius and about 350 degrees Celsius, more preferably to a temperature of between about 200 degrees Celsius and about 220 degrees Celsius.

The electrically operated aerosol-generating device may be configured to heat the aerosol-generating article externally. An elongate heating chamber is provided, which is adapted to receive the aerosol-generating article and the heater element is provided circumferentially around the heating chamber to partially or fully surround the aerosol-generating article within the chamber so that the rod of aerosol-generating substrate is heated.

Alternatively, the electrically operated aerosol-generating device may be configured to heat the aerosol-generating article internally, from within the tubular carrier element. A heater element in the form of an elongate heater blade or pin is provided, which is adapted to be inserted into the rod of aerosol-generating substrate in order to heat the aerosol-generating film.

In any of the aerosol-generating systems according to the invention, the heater element may be of any suitable form to conduct heat. The aerosol-generating system may be an electrically-operated aerosol generating system comprising an inductive heating device.

Inductive heating devices typically comprise an induction source that is configured to be coupled to a susceptor. The induction source generates an alternating electromagnetic field that induces magnetization or eddy currents in the susceptor. The susceptor may be heated as a result of hysteresis losses or induced eddy currents heat the susceptor through ohmic or resistive heating.

Electrically operated aerosol-generating systems comprising an inductive heating device may also comprise the aerosol-generating article having the aerosol-generating film and a susceptor in thermal proximity to the aerosol-generating film. The susceptor is heated through hysteresis losses or induced eddy currents, which in turn heats the aerosol-generating film. Typically, the susceptor is in direct contact with the aerosol-generating film and heat is transferred from the susceptor to the aerosol-generating film primarily by conduction. Examples of electrically operated aerosol-generating systems having inductive heating devices and aerosol-generating articles having susceptors are described in WO-A1-95/27411 and WO-A1-2015/177255.

The invention will now be further described with reference to the figures in which.

Figure 1:
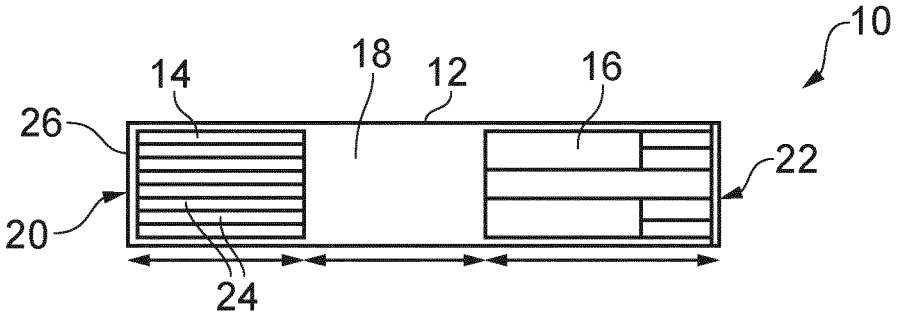
FIG. 1 shows a schematic longitudinal cross-sectional view of an aerosol-generating article according to a first embodiment of the invention.

The aerosol-generating article 10 shown in FIG. 1 comprises a tubular carrier element 12, a rod of aerosol-generating substrate 14 and a flow restriction element 16.

The tubular carrier element 12 is in the form of a paper tube having a length of approximately 12 millimetres and an external diameter of approximately 7 millimetres. The tubular carrier element 12 is cylindrical in shape and defines a longitudinally extending internal cavity 18 extending from an upstream end 20 of the tubular carrier element 12 to a downstream end 22.

The rod of aerosol-generating substrate 14 comprises a plurality of layers 24 of an aerosol-generating film. As shown in FIG. 1, each of the plurality of layers 24 extends in a longitudinal direction along the full length of the rod 14. Although not shown in FIG. 1, the layers 24 are spaced apart from each other in the transverse direction. Each of the layers 24 has a thickness of approximately 0.25 millimetres and a length of approximately 10 millimetres. The rod contains approximately 30 sheets. The total amount of the aerosol-generating film within the rod 14 is approximately 200 mg. The exposed surface area of the layers 24 of aerosol-generating film is greater than 5 square millimetres per mg of the aerosol-generating film.

The bulk density of the aerosol-generating film within the rod 14 is greater than 100 mg per cubic centimetre of the rod 14.

The aerosol-generating film 14 has the following composition:

| Aerosol-generating film composition (w/w) |
|---|
| 19.3% HPMC |
| 4.8% Agar |
| 1.4% Nicotine |
| 48% Glycerin |
| 2.1% Levulinic Acid |
| 24.4% Water |

The flow restriction element 16 comprises a single segment of cellulose acetate tow which is provided within the internal cavity 18 of the tubular carrier element 12, at the downstream end 22. The flow restriction element 16 has a length of approximately 20 millimetres and an external diameter corresponding to the diameter of the internal cavity 18 of the tubular carrier element 12. The flow restriction element 16 is downstream of the aerosol-generating film 14 and spaced apart from the aerosol-generating film 14 such that an empty space is defined inside the tubular carrier element 12, between the downstream end of the aerosol-generating film 14 and the upstream end of the flow restriction element 16.

The upstream end 20 of the tubular carrier element 12 is sealed by means of upstream sealing element 26 which comprises a sheet of aluminium provided over the end of the tubular carrier element 12 to seal the upstream end of the internal cavity 18.

The aerosol-generating article 10 shown in FIG. 1 is suitable for use with an electrically operated aerosol-generating device comprising a heater for heating the aerosol-generating film 14.

Figure 2:
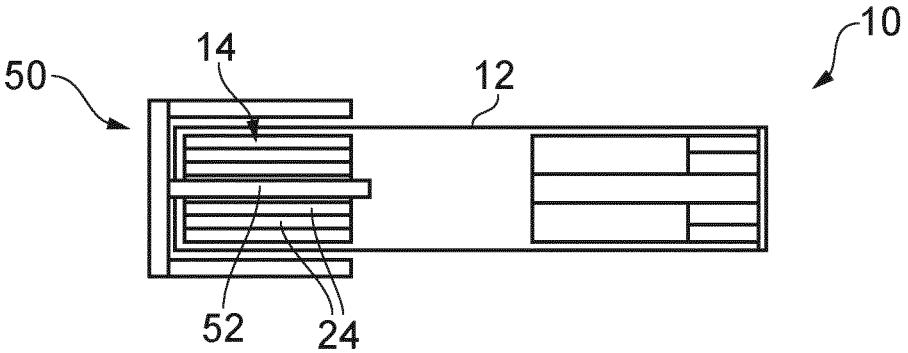
FIG. 2 shows a schematic longitudinal cross-sectional view of the aerosol-generating article of FIG. 1 in combination with an internal heater element of an aerosol-generating device.

FIG. 2 shows a schematic view of the aerosol-generating article 10 being heated in an aerosol-generating device 50 having a heater blade 52. The aerosol-generating article is inserted into the aerosol-generating device 50 such that the heater blade 52 pierces through the upstream sealing element 24 and is inserted into the rod of aerosol-generating substrate 14 between the layers of aerosol-generating film 24.

During use, the heater blade 52 heats the layers 24 of the aerosol-generating film to a temperature sufficient to generated an aerosol from the aerosol-generating film. The aerosol is drawn through the flow restriction element 16 and out through the downstream end 22 of the tubular carrier element.

Figure 3:
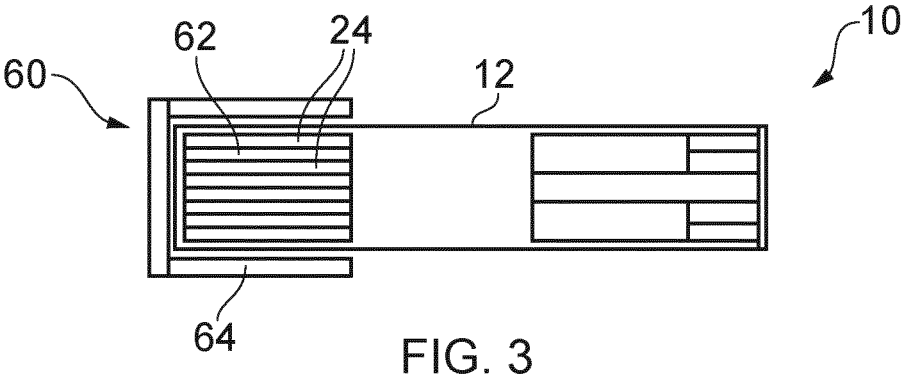
FIG. 3 shows a schematic longitudinal cross-sectional view of the aerosol-generating article of FIG. 1 in combination with an external heater element of an aerosol-generating device.

FIG. 3 shows a schematic view of the aerosol-generating article 10 being heated in an alternative aerosol-generating device 60 having a heating chamber 62 into which the upstream end of the aerosol-generating article is inserted such that an external heater element 64 surrounds the upstream part of the tubular carrier element 12 incorporating the rod of aerosol-generating substrate 14. The heater element 64 heats the layers 24 of aerosol-generating film in the rod of aerosol-generating substrate 14 circumferentially from outside the tubular carrier element 12.

The aerosol-generating device 60 further comprises a piercing element 66 which pierces the upstream sealing element 24 as the aerosol-generating article 10 is inserted into the heating chamber 62.

Figure 4:
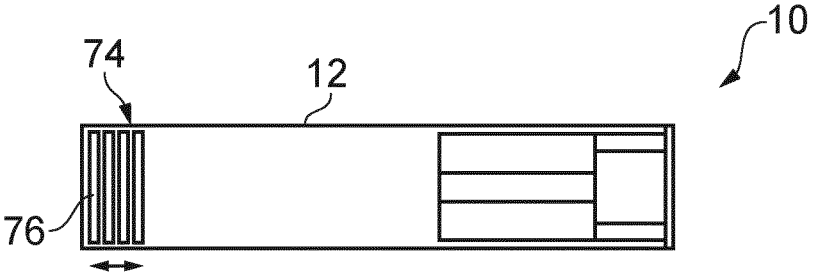
FIG. 4 shows a schematic longitudinal cross-sectional view of an aerosol-generating article according to a second embodiment of the invention.

FIG. 4 shows an aerosol-generating article 70 according to a second embodiment of the present invention, which is similar in construction to the aerosol-generating article 10 shown in FIG. 1 but comprises a rod of aerosol-generating substrate 74 having a different configuration of aerosol-generating film.

The rod 74 comprises a plurality of layers 76 of aerosol-generating film. As shown in FIG. 4, each of the layers 76 of aerosol-generating film extends in a transverse direction. The layers 76 are parallel to each other and stacked such that adjacent layers are in contact with each other, with no longitudinal spacing between them. The layers 76 are circular in shape and have a diameter substantially corresponding to the diameter of the internal cavity 18 of the tubular carrier element 12. Each of the layers 76 has a thickness of approximately 0.25 millimetres and the rod contains approximately 45 layers. The length of the rod 74 is approximately 5 millimetres. The total amount of the aerosol-generating film within the rod 74 is approximately 200 mg.

The exposed surface area of the layers 76 of aerosol-generating film is greater than 5 square millimetres per mg of the aerosol-generating film.

The bulk density of the aerosol-generating film within the rod 74 is greater than 100 mg per cubic centimetre of the rod 74.

Each of the layers 76 comprises a plurality of air flow holes (not shown) arranged over the surface, which provide the layers 76 with sufficient porosity to enable air flow through the rod 74 during use.

The aerosol-generating article 70 may be heated in an aerosol-generating device as described above with reference to the aerosol-generating article 10.

It will be appreciated that the aerosol-generating articles 10 shown in FIG. 1 may also be suitable for use with other types of aerosol-generating devices.

The invention claimed is:

1. An aerosol-generating article comprising a rod of aerosol-generating substrate, wherein the rod of aerosol-generating substrate comprises:

an aerosol-generating film comprising at least 25 percent by weight of a polyhydric alcohol and at least 10 percent by weight of a cellulose based film-forming agent, wherein the aerosol-generating film is configured such that an exposed surface area of the aerosol-generating film within the aerosol-generating substrate is at least 5 square millimeters per mg of the aerosol-generating film, wherein the aerosol-generating film is substantially tobacco-free, and wherein the cellulose based film-forming agent is selected from the group consisting of hydroxypropyl methylcellulose (HPMC), methylcellulose (MC), ethylcellulose (EC), hydroxyethyl methyl cellulose (HEMC), hydroxyethyl cellulose (HEC), hydroxypropyl cellulose (HPC), and combinations thereof.

2. An aerosol-generating article comprising a rod of aerosol-generating substrate, wherein the rod of aerosol-generating substrate comprises:

an aerosol-generating film comprising at least 25 percent by weight of a polyhydric alcohol and at least 10 percent by weight of a cellulose based film-forming agent, wherein the aerosol-generating film is configured such that a bulk density of the aerosol-generating film is at least 100 mg per cubic centimeter of the rod of aerosol-generating substrate, wherein the aerosol-generating film is substantially tobacco-free, and wherein the cellulose based film-forming agent is selected from the group consisting of hydroxypropyl methylcellulose (HPMC), methylcellulose (MC), ethylcellulose (EC), hydroxyethyl methyl cellulose (HEMC), hydroxyethyl cellulose (HEC), hydroxypropyl cellulose (HPC), and combinations thereof.

3. The aerosol-generating article according to claim 1, wherein the rod of aerosol-generating substrate comprises a plurality of stacked layers of the aerosol-generating film.

4. The aerosol-generating article according to claim 3, wherein the plurality of layers of the aerosol-generating film are stacked such that each layer extends in a transverse direction of the aerosol-generating article.

5. The aerosol-generating article according to claim 3, wherein the plurality of layers of the aerosol-generating film are stacked such that each layer extends in a longitudinal direction of the aerosol-generating article.

6. The aerosol-generating article according to claim 3, wherein the aerosol-generating substrate comprises a tubular carrier element defining a longitudinally extending internal channel, and wherein the plurality of stacked layers is provided within the internal channel.

7. The aerosol-generating article according to claim 3, wherein the plurality of stacked layers of the aerosol-generating film comprises between 2 and 50 stacked layers.

8. The aerosol-generating article according to claim 2, wherein the rod of aerosol-generating substrate comprises a plurality of stacked layers of the aerosol-generating film.

9. The aerosol-generating article according to claim 8, wherein the plurality of layers of the aerosol-generating film are stacked such that each layer extends in a transverse direction of the aerosol-generating article.

10. The aerosol-generating article according to claim 8, wherein the plurality of layers of the aerosol-generating film are stacked such that each layer extends in a longitudinal direction of the aerosol-generating article.

11. The aerosol-generating article according to claim 8, wherein the aerosol-generating substrate comprises a tubular carrier element defining a longitudinally extending internal channel, and wherein the plurality of stacked layers is provided within the internal channel.

12. The aerosol-generating article according to claim 8, wherein the plurality of stacked layers of the aerosol-generating film comprises between 2 and 50 stacked layers.

13. The aerosol-generating article according to claim 1, wherein the rod of aerosol-generating substrate comprises one or more gathered layers of the aerosol-generating film.

14. The aerosol-generating article according to claim 1, wherein the rod of aerosol-generating substrate comprises a plurality of strips of the aerosol-generating film.

15. The aerosol-generating article according to claim 1, wherein a thickness of the aerosol-generating film is between 0.1 millimeter and 0.5 millimeter.

16. The aerosol-generating article according to claim 1, wherein the aerosol-generating film is textured or crimped.

17. The aerosol-generating article according to claim 1, wherein the aerosol-generating film is provided on at least one surface of a carrier layer or a paper layer.

18. A rod for use as an aerosol-generating substrate in an aerosol-generating article, the rod comprising:

an aerosol-generating film comprising at least 25 percent by weight of a polyhydric alcohol and at least 10 percent by weight of a cellulosic film-forming agent, wherein the aerosol-generating film is configured such that an exposed surface area of the aerosol-generating film within the aerosol-generating substrate is at least 5 square millimeters per mg of the aerosol-generating film, wherein the aerosol-generating film is substantially tobacco-free, and wherein the cellulosic film-forming agent is selected from the group consisting of hydroxypropyl methylcellulose (HPMC), methylcellulose (MC), ethylcellulose (EC), hydroxyethyl methyl cellulose (HEMC), hydroxyethyl cellulose (HEC), hydroxypropyl cellulose (HPC), and combinations thereof.

19. A rod for use as an aerosol-generating substrate in an aerosol-generating article, the rod comprising:

an aerosol-generating film comprising at least 25 percent by weight of a polyhydric alcohol and at least 10 percent by weight of a cellulose based film-forming agent, wherein the aerosol-generating film is configured such that a bulk density of the aerosol-generating film is at least 100 mg per cubic centimeter of the rod of aerosol-generating substrate, wherein the aerosol-generating film is substantially tobacco-free, and wherein the cellulose based film-forming agent is selected from the group consisting of hydroxypropyl methylcellulose (HPMC), methylcellulose (MC), ethylcellulose (EC), hydroxyethyl methyl cellulose (HEMC), hydroxyethyl cellulose (HEC), hydroxypropyl cellulose (HPC), and combinations thereof.

20. An aerosol-generating system comprising an aerosol aerosol-generating article and an electrically operated aerosol-generating device comprising a heater element configured to heat an aerosol-generating substrate of the aerosol-generating article, wherein:

the aerosol-generating article comprises a rod of aerosol-generating substrate according to claim 18, and wherein the heater element is a heater blade or a heater pin configured to be inserted into the rod of aerosol-generating substrate in order to heat the aerosol-generating film.

21. The aerosol-generating article according to claim 1, wherein the aerosol-generating film comprises no more than 26 percent by weight of the cellulose based film-forming agent.

22. The aerosol-generating article according to claim 2, wherein the aerosol-generating film comprises no more than 26 percent by weight of the cellulose based film-forming agent.

* * * * *